US011712070B1

(12) United States Patent
Cutler

(10) Patent No.: US 11,712,070 B1
(45) Date of Patent: Aug. 1, 2023

(54) FOLDABLE NURSING COVER

(71) Applicant: Amy Cutler, Draper, UT (US)

(72) Inventor: Amy Cutler, Draper, UT (US)

( * ) Notice: Subject to any disclaimer, the term of this patent is extended or adjusted under 35 U.S.C. 154(b) by 0 days.

(21) Appl. No.: 17/585,959

(22) Filed: Jan. 27, 2022

(51) Int. Cl.
*A41D 1/215* (2018.01)

(52) U.S. Cl.
CPC ..... *A41D 1/215* (2018.01)

(58) Field of Classification Search
CPC . A41D 1/215; A41D 1/21; A41D 1/22; A47D 13/083; A47D 13/02; A47D 13/025; A47D 13/027; A45B 27/00
USPC ..... 2/104; D3/1, 2, 3, 4
See application file for complete search history.

(56) References Cited

U.S. PATENT DOCUMENTS 1,641,039 A * 8/1927 La Beaud ..... A41D 3/08 2/84
2,139,579 A * 12/1938 Dier ..... A41D 13/00 2/84
2,259,236 A * 10/1941 Wellins ..... A41D 1/21 2/221
2,308,140 A * 1/1943 Wupperman ..... A45B 27/00 416/73
2,911,650 A * 11/1959 Gerich ..... A41D 1/215 2/104
4,434,920 A * 3/1984 Moore ..... A47D 13/025 224/160
4,561,125 A * 12/1985 Llinas ..... A41D 1/22 2/105
4,989,268 A * 2/1991 Stolhand ..... A41D 1/215 2/104
5,018,222 A * 5/1991 Hazelbaker ..... A41B 13/00 2/48
5,440,762 A * 8/1995 Schill ..... A41D 1/215 2/48
5,469,582 A * 11/1995 Livingston ..... A41D 1/215 2/48
5,479,662 A * 1/1996 Runco ..... A41D 1/215 2/48
5,544,364 A * 8/1996 Weber ..... A41D 1/215 2/48
5,848,741 A * 12/1998 Fair ..... A47D 15/00 224/186
5,967,161 A * 10/1999 Neal ..... A42B 1/201 416/70 A
6,216,274 B1 * 4/2001 Harris ..... A41D 1/215 2/48

(Continued)

FOREIGN PATENT DOCUMENTS

KR 20090107470 A * 9/2009

OTHER PUBLICATIONS

Translation of KR 20090107470, Ho, Han Sang, Sep. 15, 2009 (Year: 2009).*

*Primary Examiner* — Heather Mangine
(74) *Attorney, Agent, or Firm* — The Iwashko Law Firm, PLLC; Lev Ivan Gabriel Iwashko

(57) ABSTRACT

A foldable nursing cover, including a folding body having an accordion shape and to cover at least a portion of a body of a user, a plurality of end coverings disposed on at least a portion of a first end of the folding body and a second end of the folding body opposite with respect to the first end to cover shoulders of the user, and an edge liner disposed on at least a portion of an edge of the folding body to prevent the folding body from collapsing.

7 Claims, 4 Drawing Sheets

(56) References Cited

U.S. PATENT DOCUMENTS 6,789,265 B1 * 9/2004 Vonrinteln ..... A41B 13/103 2/48
7,114,191 B1 * 10/2006 Butler-Penenberg ..... A41D 1/215 2/104
10,786,092 B1 * 9/2020 Yan ..... A47D 13/025
11,326,767 B1 * 5/2022 Del Vecchio ..... F21L 4/08
2003/0108421 A1 * 6/2003 DuBois ..... A45B 27/00 416/143
2004/0065704 A1 * 4/2004 Penny ..... A47D 13/025 224/628
2004/0245146 A1 * 12/2004 Kulp, III ..... A41B 13/106 206/557
2005/0084651 A1 * 4/2005 Damast ..... G09F 19/00 428/121
2006/0064797 A1 * 3/2006 Pyeatt Rowe ..... A41D 15/002 2/244
2006/0101579 A1 * 5/2006 Albers ..... A47D 13/083 5/655
2007/0105481 A1 * 5/2007 Scholz ..... A41D 1/215 450/3
2007/0243072 A1 * 10/2007 Tepporn ..... A45B 27/00 416/70 A
2010/0032460 A1 * 2/2010 Hyde ..... A47D 13/02 224/160
2011/0296581 A1 * 12/2011 Armstrong ..... A41D 1/215 2/104
2012/0240306 A1 * 9/2012 Garegnani ..... A41D 1/215 2/104
2014/0075644 A1 * 3/2014 Campbell ..... A41D 1/215 2/104
2014/0123365 A1 * 5/2014 Yoo ..... A41D 15/00 2/74
2016/0255968 A1 * 9/2016 Lee ..... A47D 13/025
2016/0295932 A1 * 10/2016 Hayward ..... A41D 1/215
2017/0006939 A1 * 1/2017 Moctezuma ..... A41D 1/14
2019/0037939 A1 * 2/2019 Larnard ..... A41D 1/215
2019/0254364 A1 * 8/2019 Ishaque ..... A41D 13/129
2019/0343196 A1 * 11/2019 Takahisa ..... A41D 27/12
2020/0196773 A1 * 6/2020 Osugi ..... G06F 3/165
2021/0037899 A1 * 2/2021 Gershona Davis .... A41D 1/215

* cited by examiner

FOLDABLE NURSING COVER

BACKGROUND

1. Field

The present general inventive concept relates generally to a nursing cover, and particularly, to a foldable nursing cover.

2. Description of the Related Art

Nursing a baby in a public setting can be a nerve-racking experience for many new mothers. Although breastfeeding in a public setting is becoming more accepted, it still attracts a lot more attention than bottle-feeding. Unsurprisingly, many new mothers feel uncomfortable having to nurse with people overlooking.

Generally, most new mothers use a blanket and/or a shirt to create privacy. However, using the blanket and/or the shirt is often restricting in practice and can be hot for the mother and/or the baby, depending on the fabric and environmental conditions.

Therefore, there is a need for a foldable nursing cover that facilitates nursing in a private manner and allow airflow.

SUMMARY

The present general inventive concept provides a foldable nursing cover.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a foldable nursing cover, including a folding body having an accordion shape and to cover at least a portion of a body of a user, a plurality of end coverings disposed on at least a portion of a first end of the folding body and a second end of the folding body opposite with respect to the first end to cover shoulders of the user, and an edge liner disposed on at least a portion of an edge of the folding body to prevent the folding body from collapsing.

The folding body may retain the accordion shape while in at least one of an extended position and a folded position.

Each of the plurality of end coverings may be distanced from each other.

The edge liner may be more rigid than the folding body.

The edge liner may be split into a first section and a second section.

The foldable nursing cover may further include a hinge disposed on at least a portion of a center of the edge liner to facilitate rotation of the first section with respect to the second section.

BRIEF DESCRIPTION OF THE DRAWINGS

These and/or other features and utilities of the present generally inventive concept will become apparent and more readily appreciated from the following description of the embodiments, taken in conjunction with the accompanying drawings of which.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Foldable Nursing Cover 100
Folding Body 110

End Coverings 120

Edge Liner 130

Hinge 140

Figure 1A:
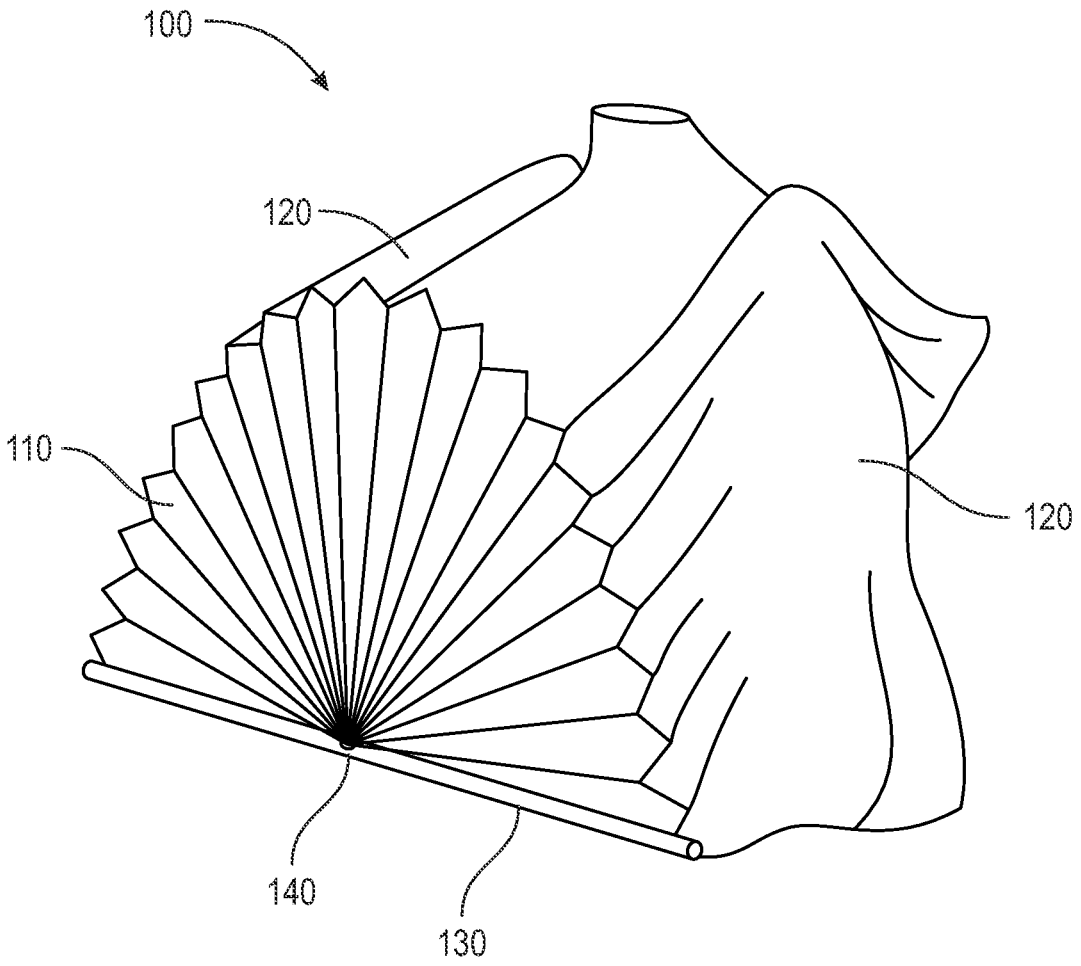
FIG. 1A illustrates an isometric top view of a foldable nursing cover, according to an exemplary embodiment of the present general inventive concept.

FIG. 1A illustrates an isometric top view of a foldable nursing cover 100, according to an exemplary embodiment of the present general inventive concept.

Figure 1B:
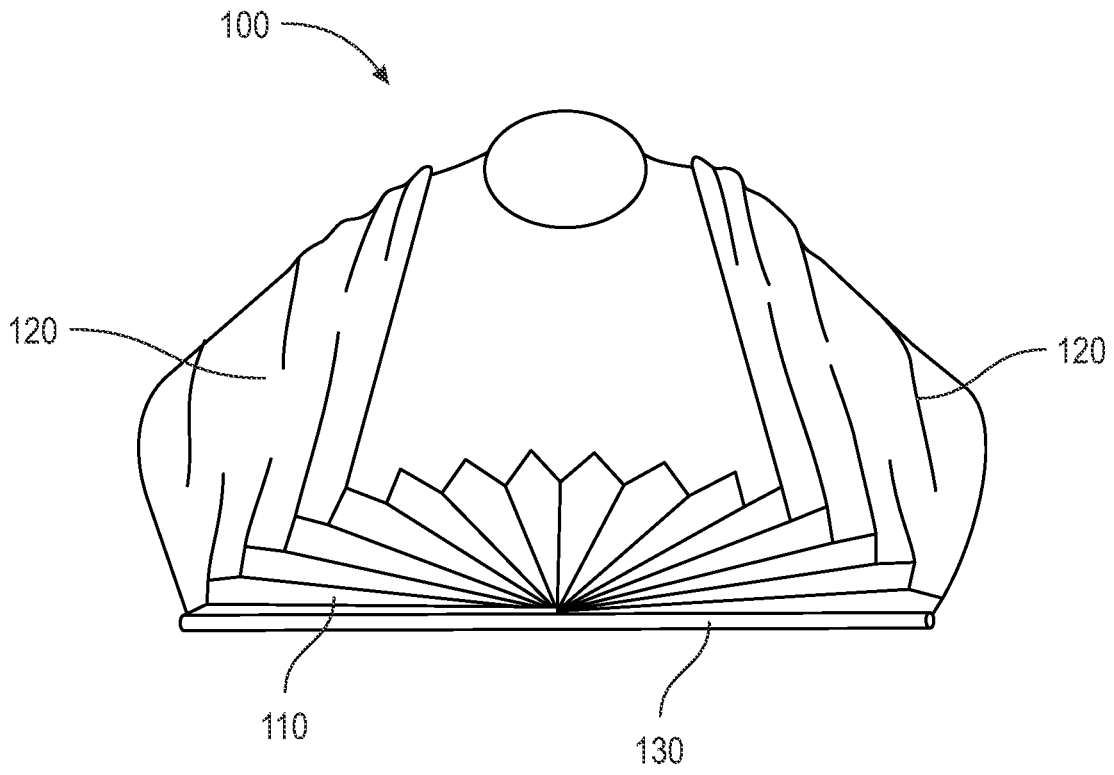
FIG. 1B illustrates a top perspective view of the foldable nursing cover, according to an exemplary embodiment of the present general inventive concept.

FIG. 1B illustrates a top perspective view of the foldable nursing cover 100, according to an exemplary embodiment of the present general inventive concept.

Figure 1C:
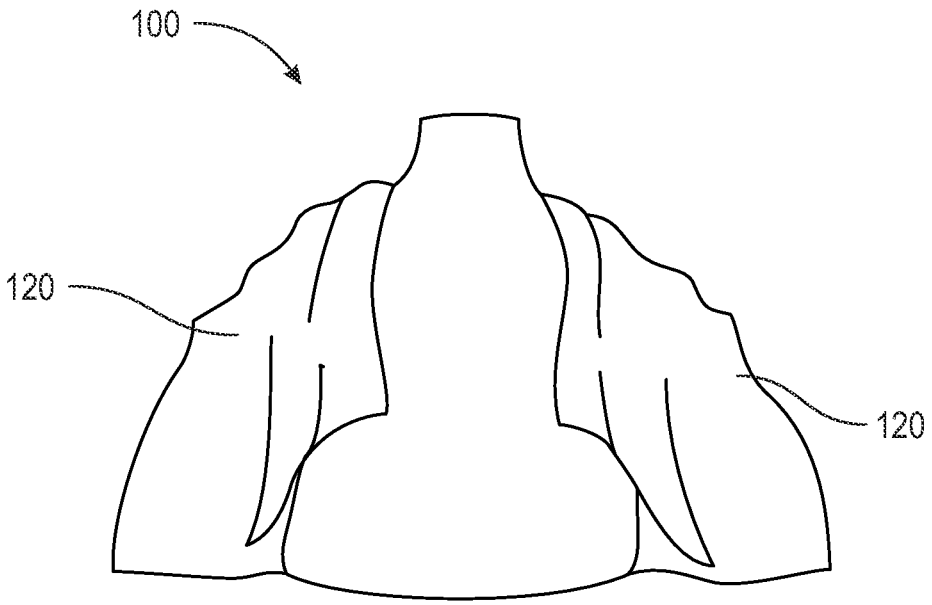
FIG. 1C illustrates a rear perspective view of the foldable nursing cover, according to an exemplary embodiment of the present general inventive concept.

FIG. 1C illustrates a rear perspective view of the foldable nursing cover 100, according to an exemplary embodiment of the present general inventive concept.

Figure 2:
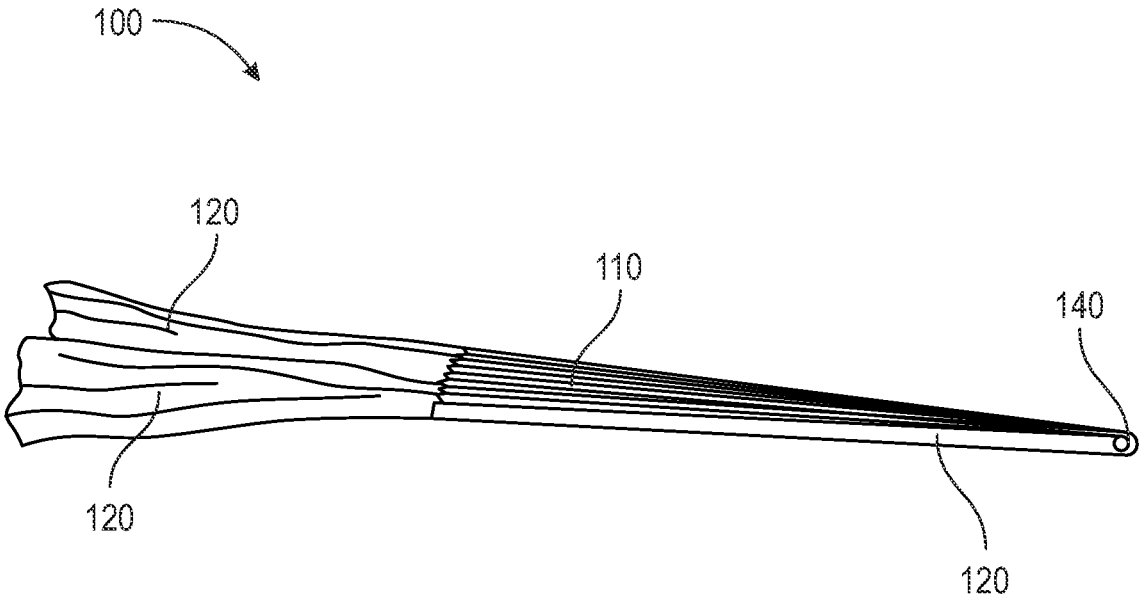
FIG. 2 illustrates a side perspective view of the foldable nursing cover in a folded position, according to an exemplary embodiment of the present general inventive concept.

FIG. 2 illustrates a side perspective view of the foldable nursing cover 100 in a folded position, according to an exemplary embodiment of the present general inventive concept.

The foldable nursing cover 100 may be constructed from at least one of fabric, cloth, metal, plastic, wood, and rubber, etc., but is not limited thereto. Also, the foldable nursing cover 100 may be hypoallergenic to protect sensitive skin.

The foldable nursing cover 100 may include a folding body 110, a plurality of end coverings 120, an edge liner 130, and a hinge 140, but is not limited thereto.

The folding body 110 may have an accordion shape. More specifically, the folding body 110 may fold upon itself in a zig zag pattern. Additionally, the folding body 110 may be rigid to create the zig zag pattern while being made of fabric. In other words, the folding body 110 may retain the zig zag pattern and/or the accordion shape while in an extended position and/or a folded position.

Additionally, the folding body 110 may be worn on at least a portion of a body of a user, such as torso of the user. As such, the folding body 110 may cover the body of the user.

Each of the plurality of end coverings 120 may be disposed on at least a portion of a first end of the folding body 110 and/or a second end of the folding body 110 opposite with respect to the first end. During use, the plurality of end coverings 120 may be worn on at least a portion of each shoulder of the user. Accordingly, the plurality of end coverings 120 may cover the shoulders of the user to stabilize the folding body 110 against the body of the user.

The plurality of end coverings 120 may at least partially deform (e.g., bend, stretch, expand) to conform to a shape and/or a size of the shoulders of the user.

Furthermore, the folding body 110 and/or the plurality of end coverings 120 may create a space between the folding body 110 and the body of the user while worn to facilitate movement of air (i.e., air flow). Also, each of the plurality of end coverings 120 may be distanced from each other (i.e., form a gap therebetween), such that a neck of the user may be disposed between each of the plurality of end coverings 120.

The edge liner 130 may be disposed on at least a portion of an edge of the folding body 110. The edge liner 130 may form a boundary around the folding body 110. Moreover, the edge liner 130 may be more rigid with respect to the folding body 110. The edge liner 130 may support the folding body 110 to maintain a position during wear. More specifically, the edge liner 130 may prevent the folding body 110 from collapsing on the user, such as being disposed on a lap of the user.

The hinge 140 may be disposed on at least a portion of a center of the edge liner 130. The edge liner 130 may be split into two sections (e.g., a first section and a second section). As such, each section of the edge liner 130 may be separate from each other and rotate with respect to each other via the hinge 140.

The foldable nursing cover 100 may facilitate nursing of a baby in private by covering the body of the user and/or the baby. Also, the foldable nursing cover 100 may provide comfort and allow air to flow during use.

The present general inventive concept may include a foldable nursing cover 100, including a folding body 110 having an accordion shape and to cover at least a portion of a body of a user, a plurality of end coverings 120 disposed on at least a portion of a first end of the folding body 110 and a second end of the folding body 110 opposite with respect to the first end to cover shoulders of the user, and an edge liner 130 disposed on at least a portion of an edge of the folding body 110 to prevent the folding body 110 from collapsing.

The folding body 110 may retain the accordion shape while in at least one of an extended position and a folded position.

Each of the plurality of end coverings 120 may be distanced from each other.

The edge liner 130 may be more rigid than the folding body 110.

The edge liner 130 may be split into a first section and a second section.

The foldable nursing cover 100 may further include a hinge 140 disposed on at least a portion of a center of the edge liner 130 to facilitate rotation of the first section with respect to the second section.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. A foldable nursing cover, comprising:

a folding body having accordion pleats and to cover at least a portion of a body of a user;

a plurality of end coverings to cover shoulders of the user, a first one of the plurality of end coverings is disposed on at least a portion of a first end of the folding body and a second one of the plurality of end coverings is disposed on at least a portion of a second end of the folding body opposite with respect to the first end; and an edge liner disposed on at least a portion of an edge of the folding body to prevent the folding body from collapsing, such that a first portion of the first one of the plurality of end coverings is disposed on the first end of the folding body at a first distance furthest from a center of the edge liner at a first end of the edge liner while the folding body is in an extended position, a second portion of the first one of the plurality of end coverings is disposed only on a center portion of the folding body at a third distance away from the first portion of the first one of the plurality of end coverings, such that a first portion of the second one of the plurality of end coverings is disposed on the second end of the folding body at a second distance furthest from the center of the edge liner at a second end of the edge liner while the folding body is in the extended position, and a second portion of the second one of the plurality of end coverings is disposed only on the center portion of the folding body at a fourth distance away from the first portion of the second one of the plurality of end coverings.

2. The foldable nursing cover of claim 1, wherein the folding body retains the accordion pleats while in at least one of the extended position and a folded position.

3. The foldable nursing cover of claim 1, wherein each of the plurality of end coverings are distanced from each other.

4. The foldable nursing cover of claim 1, wherein the edge liner is more rigid than the folding body.

5. The foldable nursing cover of claim 1, wherein the edge liner is split into a first section and a second section.

6. The foldable nursing cover of claim 5, further comprising: a hinge disposed on at least a portion of a center of the edge liner to facilitate rotation of the first section with respect to the second section.

7. A foldable nursing cover, comprising:

a folding body having accordion pleats that fold in a zig zag pattern and to cover at least a portion of a body of a user, such that the folding body retains the zig zag pattern in an extended position and a folded position;

a plurality of end coverings to cover shoulder of the user, a first one of the plurality of end coverings is disposed on at least a portion of a first end of the folding body and a second one of the plurality of end coverings is disposed on at least a portion of a second end of the folding body opposite with respect to the first end; and an edge liner disposed on at least a portion of an edge of the folding body to prevent the folding body from collapsing, such that the edge liner and the folding body fold toward the plurality of end coverings.

* * * * *